US009813789B2

(12) United States Patent
Fang et al.

(10) Patent No.: US 9,813,789 B2
(45) Date of Patent: Nov. 7, 2017

(54) SPEAKER MODULE AND ELECTRONIC DEVICE USING THE SAME

(71) Applicant: Acer Incorporated, New Taipei (TW)

(72) Inventors: Ming-Chun Fang, New Taipei (TW); Jia-Ren Chang, New Taipei (TW); Chien-Chung Chen, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 0 days.

(21) Appl. No.: 14/991,479

(22) Filed: Jan. 8, 2016

(65) Prior Publication Data

US 2017/0111719 A1 Apr. 20, 2017

(30) Foreign Application Priority Data

Oct. 15, 2015 (TW) ..... 104133818 A

(51) Int. Cl.

| | |
|---|---|
| ***H04R 1/00*** | (2006.01) |
| ***H04R 1/02*** | (2006.01) |
| ***H04R 3/12*** | (2006.01) |
| ***H04R 1/40*** | (2006.01) |

(52) U.S. Cl.
CPC ..... *H04R 1/026* (2013.01); *H04R 1/403* (2013.01); *H04R 3/12* (2013.01); *H04R 2499/15* (2013.01)

(58) Field of Classification Search
CPC ..... H04R 1/28; H04R 1/026; H04R 1/403; H04R 2499/15; H04R 2499/11
USPC ..... 381/312, 388, 333, 306
See application file for complete search history.

(56) References Cited

U.S. PATENT DOCUMENTS

2007/0291961 A1* 12/2007 Shin ..... H04M 1/0233 381/111

* cited by examiner

*Primary Examiner* — Sunita Joshi
(74) *Attorney, Agent, or Firm* — McClure, Qualey & Rodack, LLP

(57) ABSTRACT

A speaker module is provided. The speaker module includes a housing, a speaker unit, and a modulating unit. The housing has a main segment and an extension segment connecting to the main segment and extending away from the main segment. The speaker unit is disposed in the housing in a position that is relative to the main segment. The modulating unit is relative to the extension segment and disposed in the housing. The shape of a cross section of the modulating unit is compatible with the shape of a cross section of the extension segment.

9 Claims, 11 Drawing Sheets

SPEAKER MODULE AND ELECTRONIC DEVICE USING THE SAME

CROSS REFERENCE TO RELATED APPLICATIONS

This application claims priority of Taiwan Patent Application No. 104133818, filed on Oct. 15, 2015, the entirety of which is incorporated by reference herein.

BACKGROUND

Field of the Invention

The present invention relates to an electronic device and elements thereof, and more particularly to an electronic device and a speaker module thereof.

Description of the Related Art

Recently, with advances in technology, electronic devices such as mobile phones, tablet computers, e-Books, and note book computers are being widely used in day-to-day life. An electronic device generally includes a speaker module for producing sound, and the speaker module is commonly equipped with a casing and a speaker. The speaker is positioned in the casing and is used for transforming an electrical signal into structural vibration so as to generate sound. The sound quality of the speaker module is not only related to the speaker itself but also to the casing of the speaker module. Generally speaking, the casing of a speaker module with a greater volume will reduce the damping effect of the air inside the speaker module as the sound is produced by the speaker. In such a manner, the lowest resonant frequency of the speaker can be lower, thereby achieving a better low-frequency response effect, and thus improving the sound quality of the speaker module.

As mentioned above, the low-pitched sound performance of the speaker is related to the internal volume of the casing. In order to have better low-pitched sound performance, a larger casing is required. However, in a relatively small electronic device, the overall size of the speaker module is constrained, and the effective volume in the casing has to be decreased, which causes an increase of the low frequency resonant frequency of the speaker module. This increase not only degrades the low-pitched sound performance but also enhances distortion of the speaker, thereby influencing the sound quality of the electronic device.

SUMMARY

One objective of the disclosure is to provide a speaker module which is able to produce sound of a high quality so as to address the problems in the prior art.

In accordance with some embodiments of the disclosure, the speaker module includes a housing, a speaker unit, and a modulating unit. The housing has a main segment and an extension segment connecting to the main segment and extending away from the main segment. The speaker unit is disposed in the housing in a position that is relative to the main segment. The modulating unit is arranged to correspond to the extension segment and is positioned in the housing. The shape of a cross section of the modulating unit is compatible with the shape of a cross section of the extension segment.

In the above-mentioned embodiments, the extension segment comprises a first sub-segment and a second sub-segment. The modulating unit is positioned in the second sub-segment. The first sub-segment is connected to the main segment and extending in a first direction. The second sub-segment is connecting to the first sub-segment and extending in a second direction away from the main segment. the first direction is different from the second direction.

In the above-mentioned embodiments, the extension segment comprises a first sub-segment and a second sub-segment. The modulating unit is positioned in the second sub-segment. The first sub-segment is connected to the main segment and extending in a first direction. The second sub-segment is connecting to the first sub-segment and extending in a second direction away from the main segment. the first direction is the same as the second direction.

In the above-mentioned embodiments, the width of the main segment is greater than the width of the extension segment.

In the above-mentioned embodiments, the modulating module comprising one or more materials selected from a group consisting of polyurethane, Polyethylene, foam rubber, melamine, glass fiber, rockwool, OFAN polyester fiber, cyanuramide and active carbon.

In the above-mentioned embodiments, the ratio of a length of the modulating unit and a length of the extension segment is about 0.25.

In the above-mentioned embodiments, an enclosure is defined by the housing. the ratio of a length (L1) of the enclosure, between the speaker unit and the modulating unit, a length (L2) of the modulating unit, and a length (L3) of the enclosure, between the modulating unit and an end of the extension segment that is away from the speaker unit, is about 1:1:2.

In the above-mentioned embodiments, the main body has a sound outlet, and the speaker unit is arranged to correspond to the sound outlet and positioned in the housing, wherein the sound outlet is sealed by the speaker unit, and a sealed enclosure which is secluded from the surrounding is defined in the housing.

Another objective of the disclosure is to provide an electronic device using the speaker module in any one of the above-mentioned embodiments. The speaker module is positioned at two sides of the electronic device and is configured to convert electric signals from control unit in the electronic device.

BRIEF DESCRIPTION OF THE DRAWINGS

For a more complete understanding of the embodiments and the advantages thereof, reference is now made to the following descriptions taken in conjunction with the accompanying drawings.

DESCRIPTION OF THE ILLUSTRATIVE EMBODIMENTS

Figure 1:
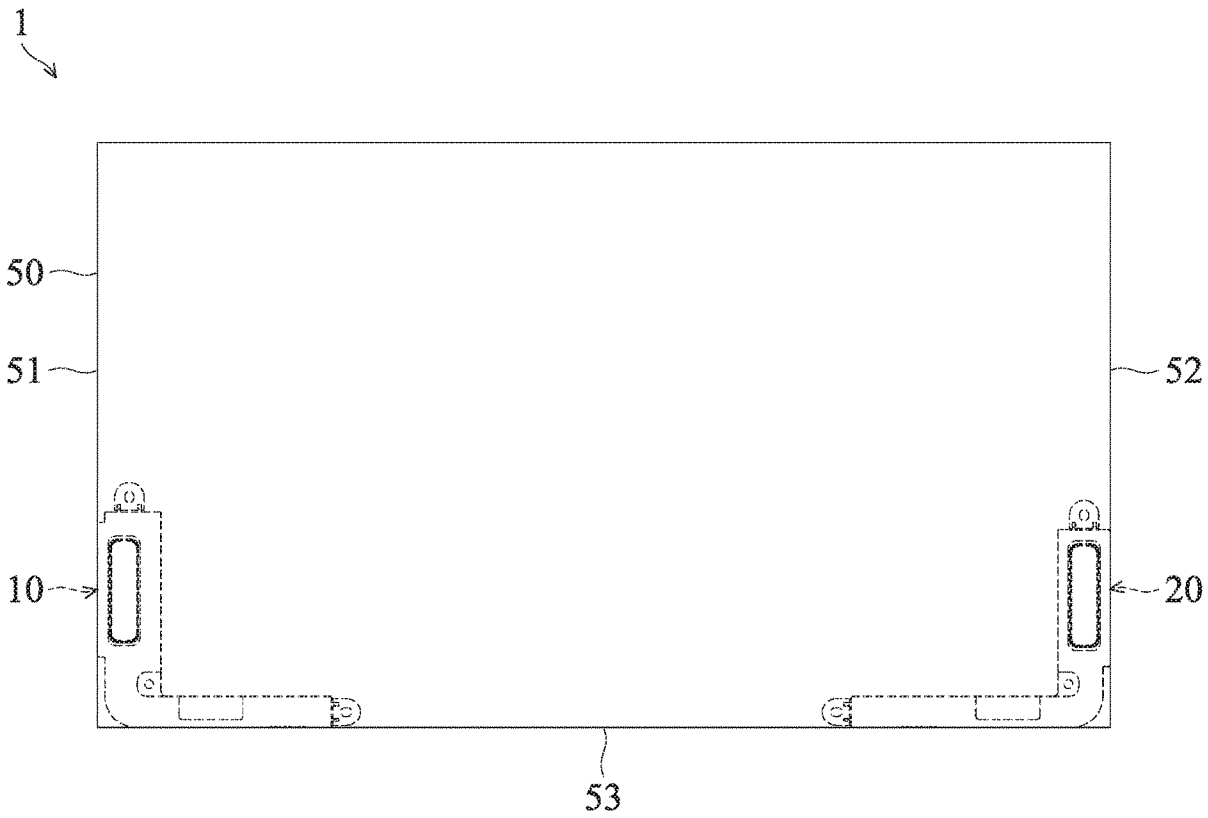
FIG. 1 shows a schematic view of an electronic device, in accordance with some embodiments.

In the following detailed description, for purposes of explanation, numerous specific details and embodiments are set forth in order to provide a thorough understanding of the present disclosure. The specific elements and configurations described in the following detailed description are set forth in order to clearly describe the present disclosure. It will be apparent, however, that the exemplary embodiments set forth herein are used merely for the purpose of illustration, and the inventive concept may be embodied in various forms without being limited to those exemplary embodiments. In addition, the drawings of different embodiments may use like and/or corresponding numerals to denote like and/or corresponding elements in order to clearly describe the present disclosure. However, the use of like and/or corresponding numerals in the drawings of different embodiments does not suggest any correlation between different embodiments.

In this specification, relative expressions are used. For example, "lower", "bottom", "higher" or "top" are used to describe the position of one element relative to another. It should be appreciated that if a device is flipped upside down, an element at a "lower" side will become an element at a "higher" side.

The terms "about" and "substantially" typically mean +/−20% of the stated value, more typically +/−10% of the stated value and even more typically +/−5% of the stated value. The stated value of the present disclosure is an approximate value. When there is no specific description, the stated value includes the meaning of "about" or "substantially".

FIG. 1 shows a schematic view of an electronic device 1, in accordance with some embodiments. In some embodiments, the electronic device 1 (such as watch, tablet, and notebook) includes a base 50, a number of speaker modules (such as the speaker modules 10 and 20), and a control unit (not shown in the figures). The speaker modules 10 and 20 and the control unit are positioned in the base 50. The control unit is configured to transmit signals, and the speaker modules 10 and 20 produces sound according to the signal transmitted from the control unit. It should be appreciated that the numbers of the elements of the electronic device 1 can be added or omitted, and the disclosure should not be limited to the embodiments.

In accordance with some embodiments, the speaker modules 10 and 20 are arranged at two opposite sides of the base 50 so as to optimize user's experience. Specifically, as shown in FIG. 1, the base 50 includes a first side 51, a second side 52, and a third side 53. The first side 51 and the second side 52 are arranged opposite to each other. The third side 53 connects the first side 51 to the second side 52. The speaker module 10 has an L-shaped and is positioned at the intersection of the first and the third sides 51 and 53, wherein a portion of the speaker module 10 extends parallel to the first side 51, and the other portion of the speaker module 10 extends parallel to the third side 53. The speaker module 20 has an L-shaped and is positioned at the intersection of the second and the third sides 52 and 53, wherein a portion of the speaker module 20 extends parallel to the second side 52, and the other portion of the speaker module 10 extends parallel to the third side 53. In some embodiments, the structure features of the speaker module 10 are similar to the structure features of the speaker module 20, and thus the descriptions regarding to the speaker module 20 is omitted for brevity. However, the disclosure should not be limited thereto, the structure features of the speaker module 10 may be different from the structure features of the speaker module 20.

Figure 2:
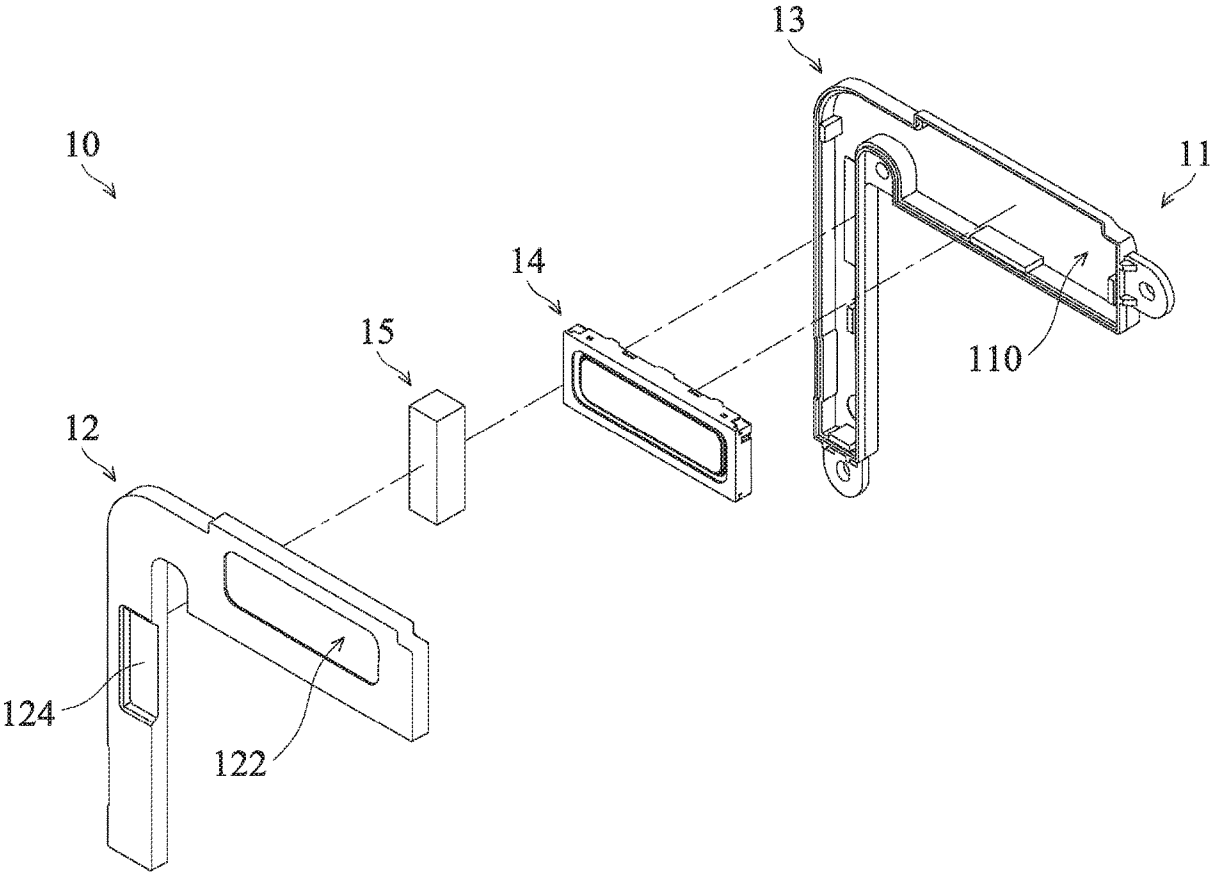
FIG. 2 shows a schematic view of a speaker module, in accordance with some embodiments.

Referring to FIG. 2, in accordance with some embodiments, the speaker module 10 includes a housing 11, a speaker unit 14, and a modulating unit 15. In some embodiments, the housing 11 includes an upper housing member 12 and a lower housing member 13. The upper housing member 12 is connected to the lower housing member 13, and an enclosure 110 is defined inside the housing 11 by the upper and the lower housing members 12 and 13. The speaker unit 14 and the modulating unit 15 are positioned in the enclosure 110 and are arranged to be separated from one another.

Figure 3:
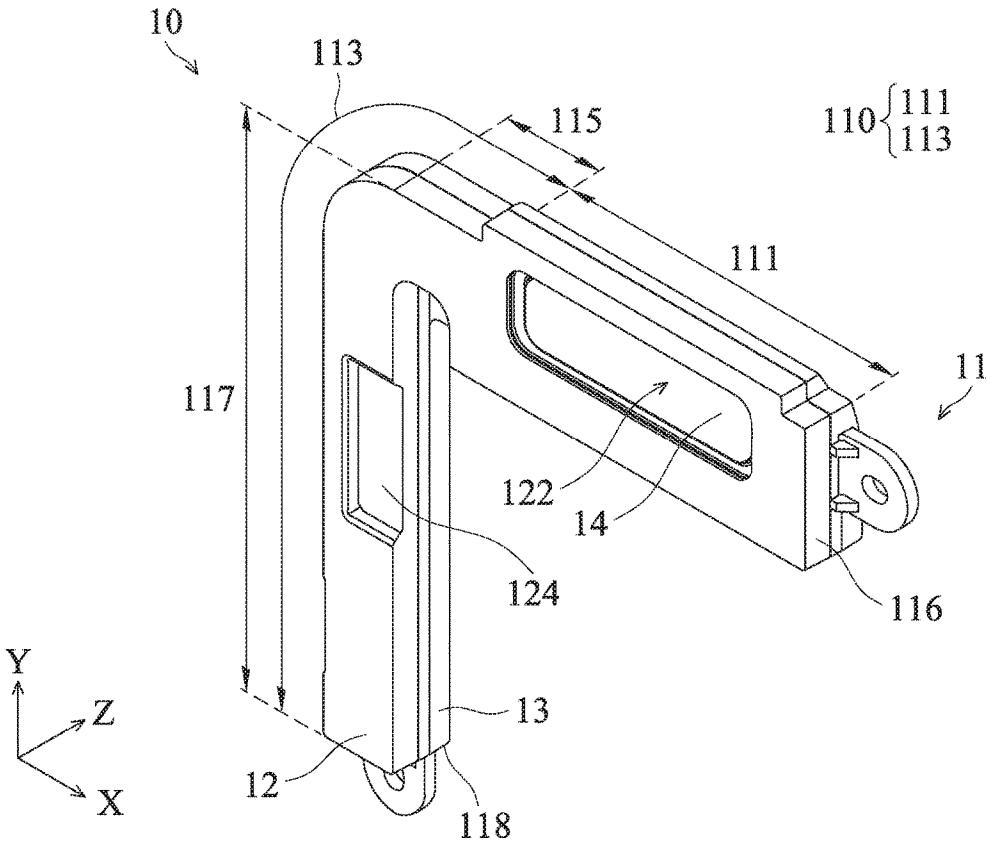
FIG. 3 shows an exploded view of a speaker module, in accordance with some embodiments.

Referring to FIG. 3, the enclosure 110 includes a main segment 111 and an extension segment 113. The main segment 111 extends in a first direction (a direction parallel to the X-axis) from a first end 116 of the housing 11 for a determined distance. The extension segment 113 includes a first sub-segment 115 and a second sub-segment 117. The first sub-segment 115 is connected to the main segment 111 and extends in the first direction for a determined distance. The second sub-segment 117 is connected to the first sub-segment 115. The second sub-segment 117 extends in a second direction (a direction parallel to the Y-axis) from the first sub-segment 115 and terminates at a second end 118 of the housing 11.

Figure 4:
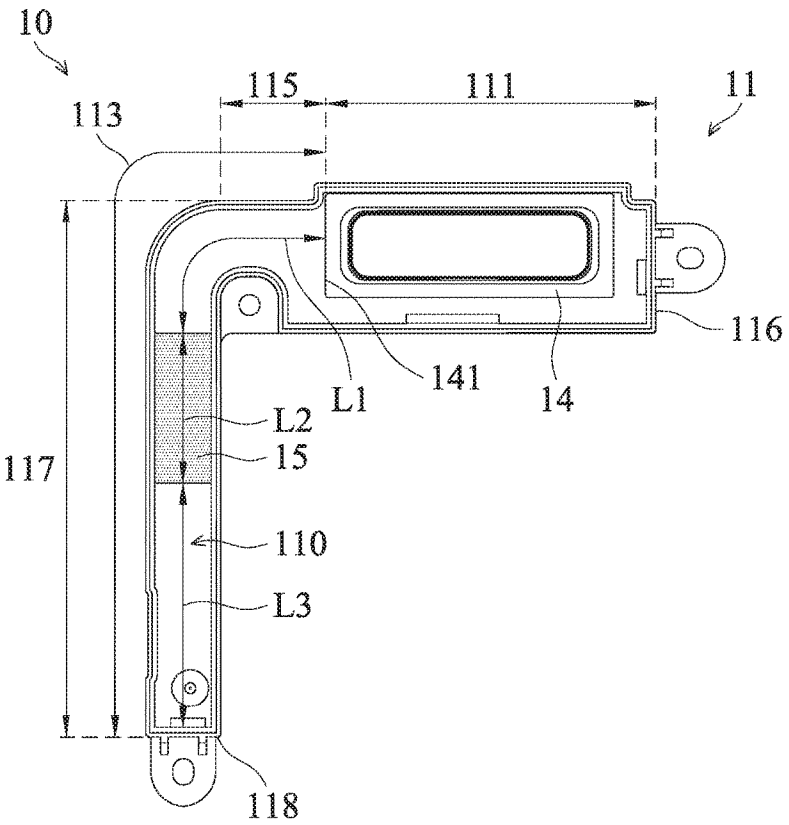
FIG. 4 shows a cross-sectional view of some elements of a speaker module, in accordance with some embodiments.

Specifically, as shown in FIG. 4, a first boundary line between the main segment 111 and the first sub-segment 115 is located at a lateral side 141 of the speaker unit 14, and a second boundary line between the first sub-segment 115 and the second sub-segment 117 is located parallel to the first boundary line. Additionally, a portion of the second sub-segment 117 which is immediately connected to the first sub-segment 115 has a curved edge. As a whole, the housing 11 is L-shaped, and the width of the main segment 111 is greater than a width of the first segment 115.

Referring to FIG. 3, a sound outlet 112 is formed on a portion of the upper housing member 12 relative to the main segment 111. The speaker unit 14 is arranged to correspond to the sound outlet 112 and is positioned in the main segment 111. In some embodiments, the enclosure 110 is sealed by the upper and lower housing members 12 and 13, but communicates with the exterior via the sound outlet 112. However, after the assembly of the speaker unit 14, the edge of the sound outlet 112 is sealed by the speaker unit 14, and thus the enclosure 110 is sealed by the speaker unit 14.

Figure 5:
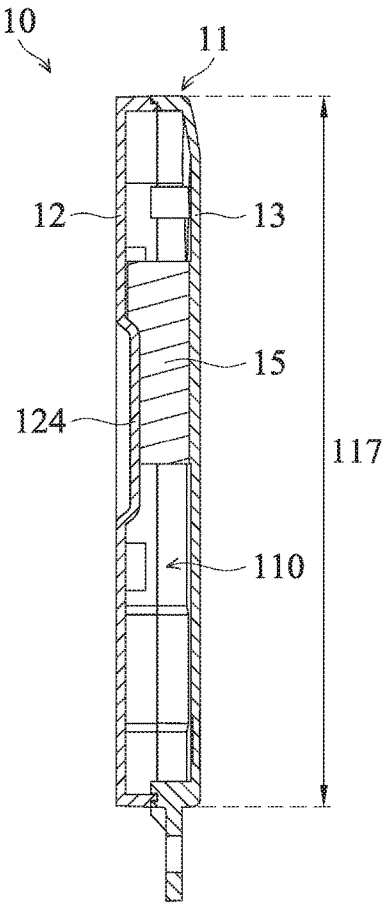
FIG. 5 shows a schematic view of a speaker module, in accordance with some embodiments.

Referring to FIG. 5, the shape of a cross section of the modulating unit 15 is compatible with the shape of a cross section of the extension segment 113. In some embodiments, the modulating unit 15 is made of a deformable material. Before being compressed, an area of the cross section of the modulating unit 15 is greater than an area of the cross section of the extension segment 113. As the modulating unit 15 is positioned in the enclosure 110, at least a portion of the modulating unit 15 is deformed due to the compression of the upper and the lower housing members 12 and 13. In addition, the entire outer surface of the modulating unit 15 in a peripheral direction is completely in contact with the inner wall of the enclosure 110. In some embodiments, before being compressed, an area of the cross section of the modulating unit 15 is substantially equal to an area of the cross section of the extension segment 113. The profile of the modulating unit 15 is compatible with the shape of the inner wall of the enclosure 110.

In some embodiments, the modulating module 15 is made of material having sound-absorbing characteristics. For example, the modulating module 15 is made of a material that includes one or more materials selected from a group consisting of polyurethane, Polyethylene, foam rubber, melamine, glass fiber, rockwool, OFAN polyester fiber, cyanuramide, and active carbon.

In some embodiments, a depression structure 124 is formed on a portion of the upper housing member 12 relative to the second sub-segment 117. The depression structure 124 is depressed inwardly. In some embodiments, the modulating unit 15 is arranged to correspond to the depression structure 124 and positioned in the second sub-segment 117. In some embodiments, the depression structure 124 is omitted, and the modulating unit 15 is positioned in any position in the second sub-segment 117. The modulating unit 15 is not arranged to correspond to the depression structure 124.

Referring to FIG. 4, in some embodiments, the length of the enclosure 110 between the speaker unit 14 and the modulating unit 15 is of L1, and the length of the enclosure 110 between the modulating unit 15 and the second end 118 of the housing 11 is of L3. The length L1 is smaller than the length L3. For example, the ratio of the length L1, a length L2 of the modulating unit 15, and the length L3 is of about 1:1:2. However, the disclosure should not be limited thereto. The length L1, the length L2, and the length L3 may be varied according to acoustic design requirements. In some embodiments, the length L2 of the modulating module 15 and the overall length of the extension segment 113 (sum of the lengths L1, L2, and L3) is of about 1:4 (0.25).

In one exemplary embodiment, the modulating unit 15 of the speaker module 10 has a length L2 of 12 mm. An upper enclosure of the speaker module 10 (a portion of the enclosure 110 between the speaker unit 14 and the modulating unit 15) has a length L1 of 9 mm. A lower enclosure of the speaker module 10 (a portion of the enclosure 110 between the modulating unit 15 and the second end 118 of the housing 11) has a length L3 of 23.92 mm. That is, the ratio of the length L1 and the length L3 is about 3:8.

Figure 6:
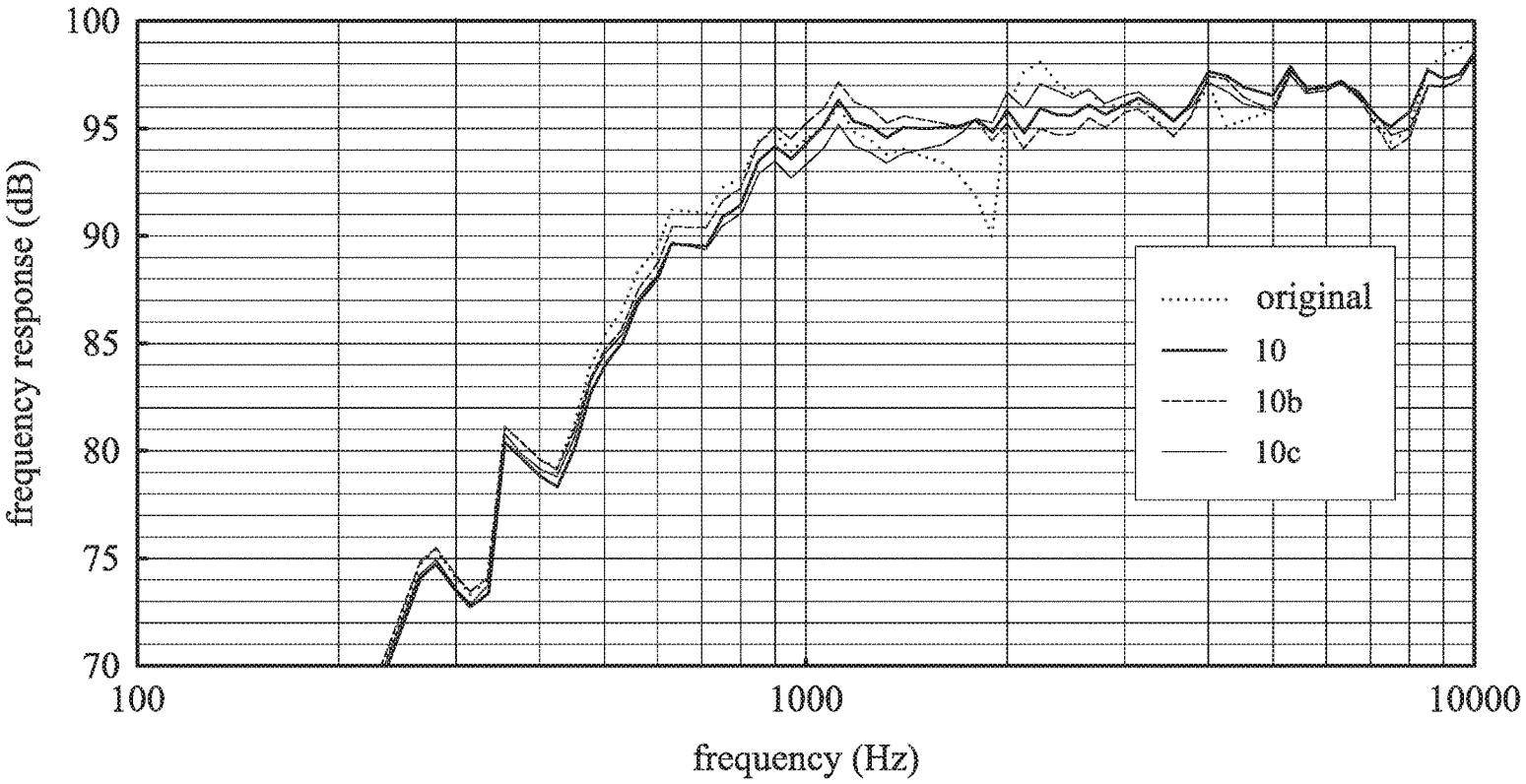
FIG. 6 is a diagram showing frequency response of speaker modules, in accordance with some embodiments.
Figure 7:
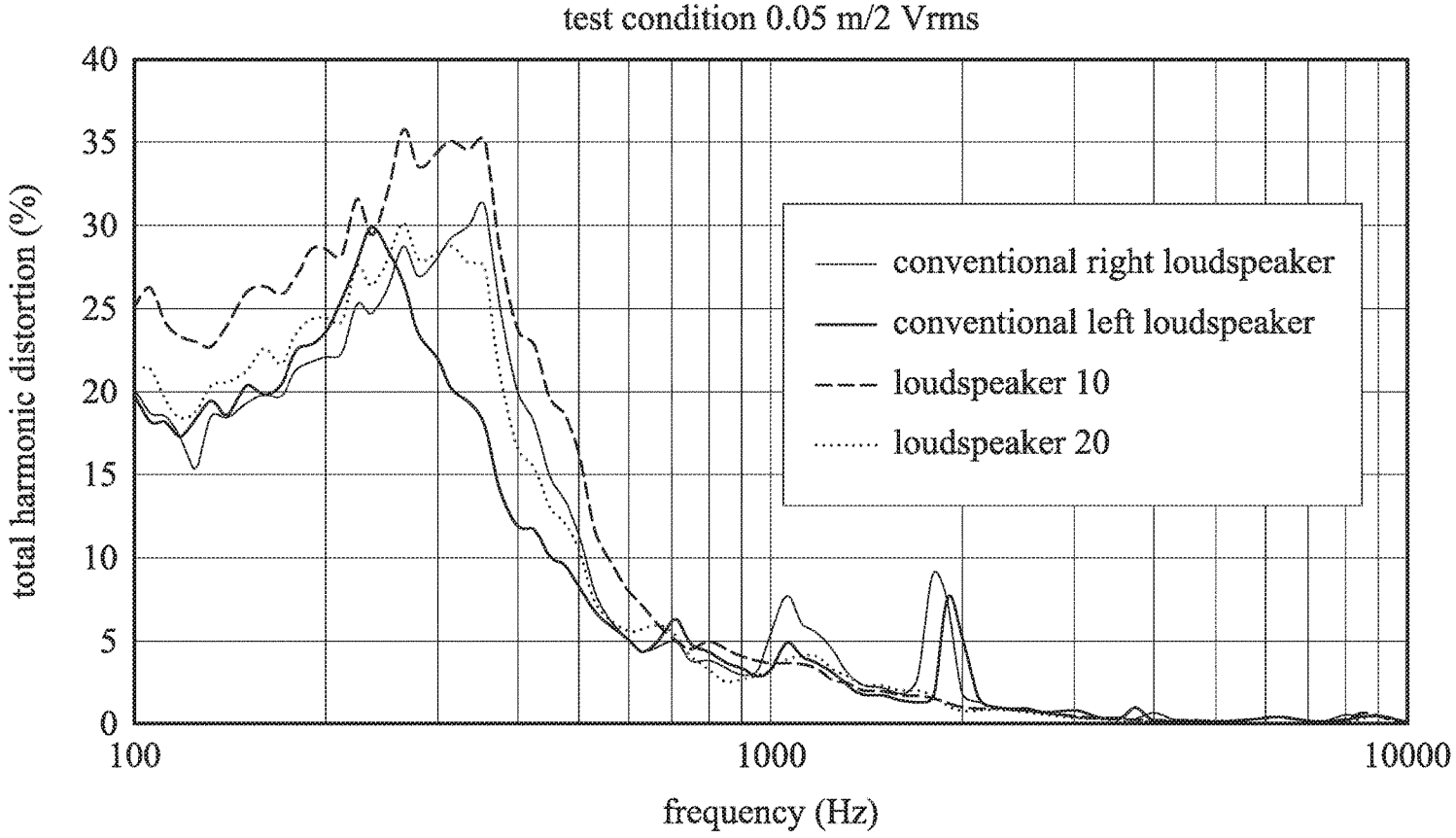
FIG. 7 is a diagram showing THD of speaker modules, in accordance with some embodiments.

As shown in FIG. 6, compared with a speaker module without the modulating module 15, in the above exemplary embodiment, the wave valley of the frequency response increases 4 dB, and the wave peak of the frequency response decreases 2 dB. Additionally, as shown in FIG. 7, in the condition of the speaker modules 10 and 20 are operated in a frequency between 100 Hz to 2000 Hz, the sound distortion is inhibited. With a "planarization" acoustic characteristic, the speaker modules 10 and 20 can be applied to variety of products.

Figure 8:
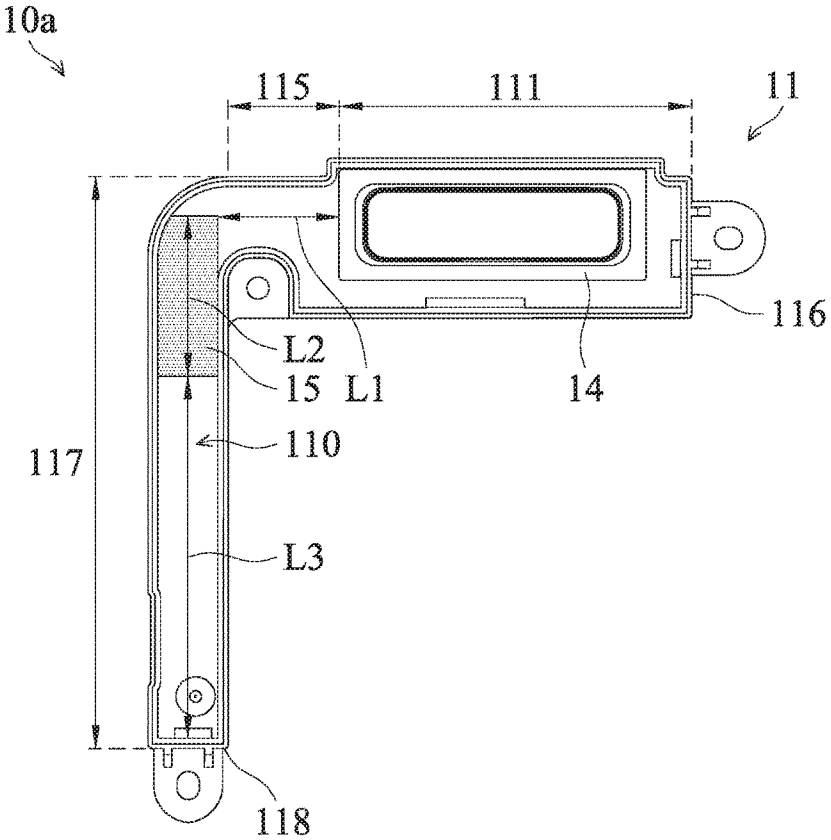
FIG. 8 shows a schematic view of an electronic device, in accordance with some embodiments.

FIG. 8 shows a schematic view of a speaker module 10*a*. In FIG. 8, elements that are identical or similar to the elements shown in FIGS. 2-5 are designated by the same reference numbers, and the features thereof are not repeated for the purpose of brevity. The differences between the speaker module 10*a* and the speaker module 10 includes the modulating element 15 is arranged much closer to the speaker unit 14 than the modulating element 15 shown in FIGS. 2-5.

In one exemplary embodiment, the modulating unit 15 of the speaker module 10*a* has a length L2 of 12 mm. An upper enclosure of the speaker module 10*a* (a portion of the enclosure 110 between the speaker unit 14 and the modulating unit 15) has a length L1 of 5 mm. A lower enclosure of the speaker module 10*a* (a portion of the enclosure 110 between the modulating unit 15 and the second end 118 of the housing 11) has a length L3 of 27.92 mm. That is, the ratio of the length L1 and the length L3 is about 1:5. As shown in FIG. 6, compared with a speaker module without the modulating module 15, in the above exemplary embodiment, the wave valley of the frequency response increases 4 dB, and the wave peak of the frequency response decreases 5 dB.

Figure 9:
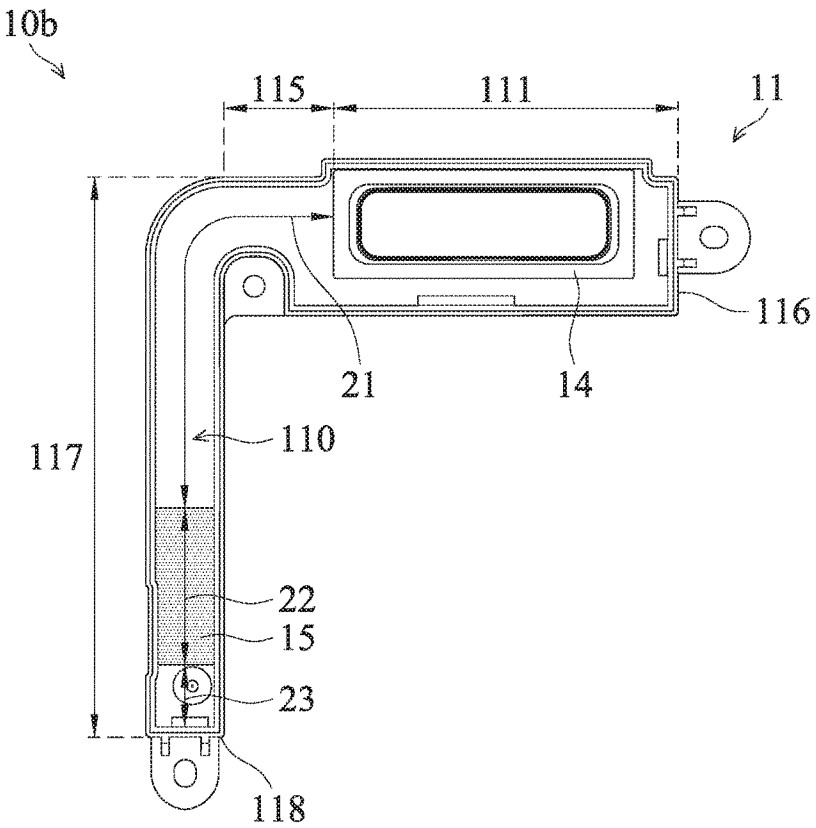
FIG. 9 shows a schematic view of an electronic device, in accordance with some embodiments.

FIG. 9 shows a schematic view of a speaker module 10*b*. In FIG. 9, elements that are identical or similar to the elements shown in FIGS. 2-5 are designated by the same reference numbers, and the features thereof are not repeated for the purpose of brevity. The differences between the speaker module 10*b* and the speaker module 10 includes the modulating element 15 is arranged in a position farther away from the speaker unit 14 than the modulating element 15 shown in FIGS. 2-5.

In one exemplary embodiment, the modulating unit 15 of the speaker module 10*b* has a length L2 of 12 mm. An upper enclosure of the speaker module 10*b* (a portion of the enclosure 110 between the speaker unit 14 and the modulating unit 15) has a length L1 of 28 mm. A lower enclosure of the speaker module 10*b* (a portion of the enclosure 110 between the modulating unit 15 and the second end 118 of the housing 11) has a length L3 of 4.92 mm. That is, the ratio of the length L1 and the length L3 is about 7:1. As shown in FIG. 6, compared with a speaker module without the modulating module 15, in the above exemplary embodiment, the wave valley of the frequency response increases 4 dB, and the wave peak of the frequency response decreases 1 dB.

Figure 10:
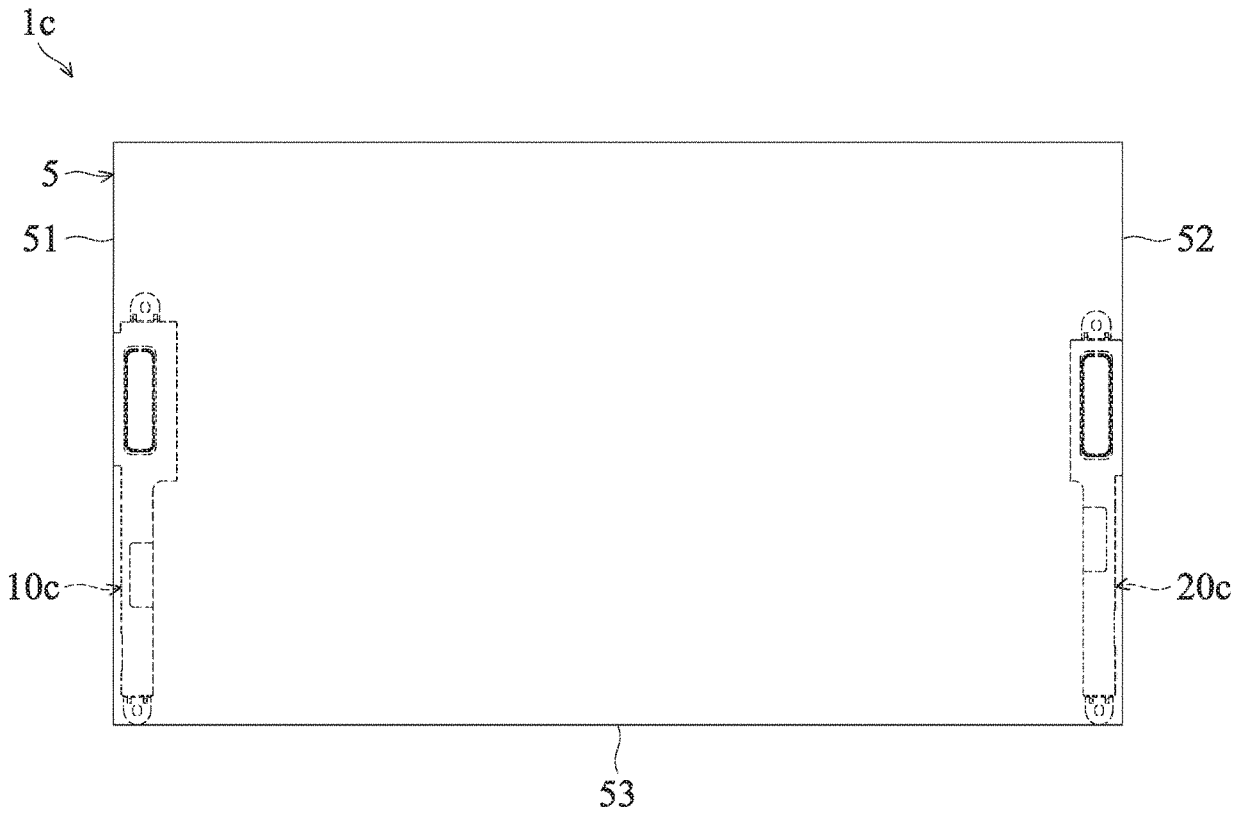
FIG. 10 shows a schematic view of a speaker module, in accordance with some embodiments.

FIG. 10 shows a schematic view of an electronic device 1*c*. In FIG. 10, elements that are identical or similar to the elements shown in FIGS. 1-5 are designated by the same reference numbers, and the features thereof are not repeated for the purpose of brevity. The differences between the electronic device 1*c* and the electronic device 1 include the speaker modules 10 and 20 are replaced by the speaker modules 10*c* and 20*c*. In some embodiments, the structure features of the speaker module 10*c* are similar to the structure features of the speaker module 20*c*, and thus the descriptions regarding to the speaker module 20*c* is omitted for brevity. However, the disclosure should not be limited thereto, the structure features of the speaker module 10*c* may be different from the structure features of the speaker module 20*c*.

Figure 11:
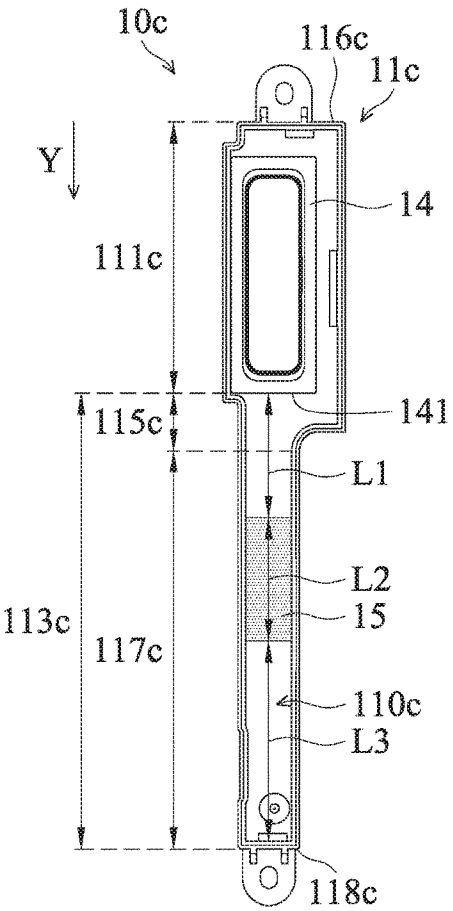
FIG. 11 shows a schematic view of a speaker module, in accordance with some embodiments.

Referring to FIG. 11, an enclosure 110*c* is defined inside the housing 11*c* of the speaker module 10*c*. The enclosure 110*c* includes a main segment 111*c* and an extension segment 113*c*. The main segment 111*c* extends in a first direction (a direction parallel to the Y-axis) from a first end 116*c* of the housing 11*c* for a predetermined distance. The extension segment 113*c* includes a first sub-segment 115*c* and a second sub-segment 117*c*. The first sub-segment 115*c* is connected to the main segment 111*c* and extends in the first direction for a determined distance. The second sub-segment 117*c* is connected to the first sub-segment 115*c*. The second sub-segment 117*c* extends in a second direction (a direction parallel to the Y-axis) from the first sub-segment 115*c* and terminates at a second end 118*c* of the housing 11*c*.

Specifically, a first boundary line between the main segment 111*c* and the first sub-segment 115*c* is located at a lateral side 141 of the speaker unit 14, and a second boundary line between the first sub-segment 115*c* and the second sub-segment 117*c* is located parallel to the first boundary line. As a whole, the housing 11*c* has a straight shape, and the width of the main segment 111*c* is greater than a width of the first segment 115*c*.

In one exemplary embodiment, the modulating unit 15 of the speaker module 10*c* has a length L2 of 12 mm. An upper enclosure of the speaker module 10*c* (a portion of the enclosure 110*c* between the speaker unit 14 and the modulating unit 15) has a length L1 of 9 mm. A lower enclosure of the speaker module 10*c* (a portion of the enclosure 110*c* between the modulating unit 15 and the second end 118 of the housing 11) has a length L3 of 23.92 mm. That is, the ratio of the length L1 and the length L3 is about 3:8. With these arrangements, the speaker module 10*c* has a "planarization" acoustic characteristic and produces sounds with inhibited distortion.

Figure 12:
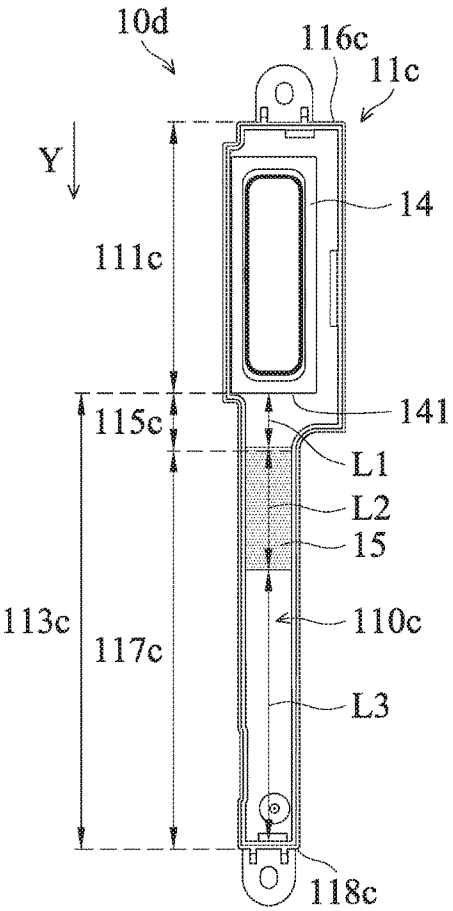
FIG. 12 shows a schematic view of a speaker module, in accordance with some embodiments.

FIG. 12 shows a schematic view of a speaker module 10*d*. In FIG. 12, elements that are identical or similar to the elements shown in FIG. 11 are designated by the same reference numbers, and the features thereof are not repeated for the purpose of brevity. The differences between the speaker module 10*d* and the speaker module 10*c* includes the modulating element 15 in the enclosure 110*c* is much closer to the speaker unit 14 than the modulating element 15 shown in FIG. 11.

In one exemplary embodiment, the modulating unit 15 of the speaker module 10*d* has a length L2 of 12 mm. An upper enclosure of the speaker module 10*d* (a portion of the enclosure 110*c* between the speaker unit 14 and the modulating unit 15) has a length L1 of 5 mm. A lower enclosure of the speaker module 10*d* (a portion of the enclosure 110*c* between the modulating unit 15 and the second end 118*c* of the housing 11*c*) has a length L3 of 27.92 mm. That is, the ratio of the length L1 and the length L3 is about 1:5. With the arrangements, the speaker module 10*d* has a "planarization" acoustic characteristic and produces sounds with inhibited distortion.

Figure 13:
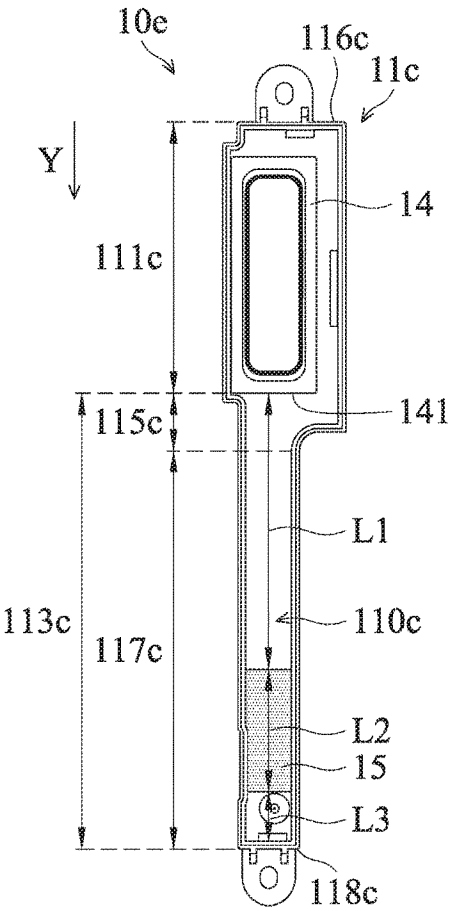
FIG. 13 shows a schematic view of a speaker module, in accordance with some embodiments.

FIG. 13 shows a schematic view of a speaker module 10*e*. In FIG. 13, elements that are identical or similar to the elements shown in FIG. 11 are designated by the same reference numbers, and the features thereof are not repeated for the purpose of brevity. The differences between the speaker module 10*e* and the speaker module 10*c* includes the modulating element 15 is disposed farther away from the speaker unit 14 than the modulating element 15 shown in FIG. 11.

In one exemplary embodiment, the modulating unit 15 of the speaker module 10*e* has a length L2 of 12 mm. An upper enclosure of the speaker module 10*e* (a portion of the enclosure 110*c* between the speaker unit 14 and the modulating unit 15) has a length L1 of 28 mm. A lower enclosure of the speaker module 10*e* (a portion of the enclosure 110*c* between the modulating unit 15 and the second end 118*c* of the housing 11*c*) has a length L3 of 4.92 mm. That is, the ratio of the length L1 and the length L3 is about 7:1. With the arrangements, the speaker module 10*d* has a "planarization" acoustic characteristic and produces sounds with inhibited distortion.

Embodiments of the micro speaker modules are able to be applied to electronic device with limited sized. The micro speaker module includes a modulating unit positioned inside of the enclosure for adjusting the capacitance value and the resistance value. Since the standing wave of the speaker module is inhibited, the sound quality of the speaker module is improved.

Although the embodiments and their advantages have been described in detail, it should be understood that various changes, substitutions, and alterations can be made herein without departing from the spirit and scope of the embodiments as defined by the appended claims. Moreover, the scope of the present application is not intended to be limited to the particular embodiments of the process, machine, manufacture, composition of matter, means, methods, and steps described in the specification. As one of ordinary skill in the art will readily appreciate from the disclosure, processes, machines, manufacture, compositions of matter, means, methods, or steps, presently existing or later to be developed, that perform substantially the same function or achieve substantially the same result as the corresponding embodiments described herein may be utilized according to the disclosure. Accordingly, the appended claims are intended to include within their scope such processes, machines, manufacture, compositions of matter, means, methods, or steps. In addition, each claim constitutes a separate embodiment, and the combination of various claims and embodiments are within the scope of the disclosure.

What is claimed is:

1. A speaker module, comprising:

a housing, having a main segment and an extension segment connected to the main segment and extending away from the main segment, wherein the main segment and the extension segment communicate with each other and form a chamber;

a speaker unit, disposed in the housing in a position that is relative to the main segment; and a modulating unit, arranged to correspond to the extension segment and positioned in the housing, wherein the shape of a cross section of the modulating unit is compatible with the shape of a cross section of the extension segment;

wherein a ratio of a length (L1) of the chamber, between the speaker unit and the modulating unit, a length (L2) of the modulating unit, and a length (L3) of the chamber, between the modulating unit and an end of the extension segment that is away from the speaker unit, is about 1:1:2.

2. The speaker module as claimed in claim 1, wherein the extension segment comprises:

a first sub-segment, connected to the main segment and extending in a first direction; and a second sub-segment, connecting to the first sub-segment and extending in a second direction away from the main segment;

wherein the modulating unit is positioned in the second sub-segment.

3. The speaker module as claimed in claim 2, wherein the first direction is different from the second direction.

4. The speaker module as claimed in claim 2, wherein the first direction is the same as the second direction.

5. The speaker module as claimed in claim 1, wherein the width of the main segment is greater than the width of the extension segment.

6. The speaker module as claimed in claim 1, wherein the modulating module comprises one or more materials selected from a group consisting of polyurethane, Polyethylene, foam rubber, melamine, glass fiber, rockwool, OFAN polyester fiber, cyanuramide, and active carbon.

7. The speaker module as claimed in claim 1, wherein the ratio of a length of the modulating unit and a length of the extension segment is about 0.25.

8. The speaker module as claimed in claim 1, wherein the main body has a sound outlet, and the speaker unit is arranged to correspond to the sound outlet and positioned in the housing;

wherein the sound outlet is sealed by the speaker unit, and a sealed chamber which is secluded from the surrounding is defined in the housing.

9. An electronic device comprising:

a speaker module comprising:

a housing, having a main segment and an extension segment connected to the main segment and extending away from the main segment, wherein the main segment and the extension segment communicate with each other and form a chamber;

a speaker unit, disposed in the housing in a position that is relative to the main segment; and a modulating unit, arranged to correspond to the extension segment and positioned in the housing, wherein the shape of a cross section of the modulating unit is compatible with the shape of a cross section of the extension segment;

wherein a ratio of a length (L1) of the chamber, between the speaker unit and the modulating unit, a length (L2) of the modulating unit, and a length (L3) of the chamber, between the modulating unit and an end of the extension segment that is away from the speaker unit, is about 1:1:2.

* * * * *